US005094020A

United States Patent [19]

Wingfield et al.

[11] Patent Number: 5,094,020

[45] Date of Patent: Mar. 10, 1992

[54] STEAM CLOSET AND HANGER FOR THE REMOVAL OF WRINKLES FROM CLOTHING

[76] Inventors: Edward C. Wingfield, 137 Tall Timbers Rd., Glastonbury, Conn. 06033; Edward P. Renaud, Rte. 354, 601 Deep River Rd., Colchester, Conn. 06415

[21] Appl. No.: 498,732

[22] Filed: Mar. 26, 1990

[51] Int. Cl.[5] ..... D06F 73/00; E05B 17/56

[52] U.S. Cl. ..... 38/1 A; 223/51; 223/85; 292/251.5

[58] Field of Search ..... 38/1 R, 1 D, 1 A; 223/11, 51, 52, 66–76, 85, 88, 92, 95; 312/21, 102, 109, 321.5; 292/251.5

[56] References Cited

U.S. PATENT DOCUMENTS

| | | | |
|---|---|---|---|
| 2,594,602 | 4/1952 | Walter | 223/95 |
| 2,703,973 | 3/1955 | Fawcett | 223/51 X |
| 2,770,849 | 11/1956 | Gavey | 292/251.5 |
| 3,050,324 | 8/1962 | Faber | 292/251.5 |
| 3,117,704 | 1/1964 | McMillan | 223/73 |
| 3,207,392 | 9/1965 | Ericson | 223/85 |
| 3,216,776 | 11/1965 | Carbury | 292/251.5 |
| 3,225,977 | 12/1965 | Gandy | 223/85 |
| 3,276,645 | 10/1966 | Buzzelli | 223/95 |
| 3,403,933 | 10/1968 | Rossow | 292/251.5 |
| 3,432,939 | 3/1969 | Eichholz | 223/51 X |
| 3,524,226 | 8/1970 | Brown | 223/85 |
| 3,601,292 | 8/1971 | Bliss | 223/51 X |
| 3,805,561 | 4/1974 | Bullock | 223/51 X |
| 3,935,976 | 2/1976 | Mizrach | 223/88 |
| 4,493,160 | 1/1985 | Brembilla | 38/1 A X |

FOREIGN PATENT DOCUMENTS

| | | | |
|---|---|---|---|
| 0660593 | 3/1965 | Belgium | 292/251.5 |
| 0324589 | 7/1989 | European Pat. Off. | 223/51 |
| 1361427 | 4/1963 | France | 223/85 |

*Primary Examiner*—Werner H. Schroeder
*Assistant Examiner*—Ismael Izaguirre
*Attorney, Agent, or Firm*—Abdallah & Muckelroy

[57] ABSTRACT

A steam closet for removal of wrinkles from clothing. The steam closet comprises an upright cabinet having sealingly engageable doors, a steam generation plant disposed within the cabinet, and a clothes hanger bar for receipt of clothing within the cabinet in spaced relationship to permit steam to circulate about all sides of the clothing hung within the cabinet.

5 Claims, 5 Drawing Sheets

FIG. 3
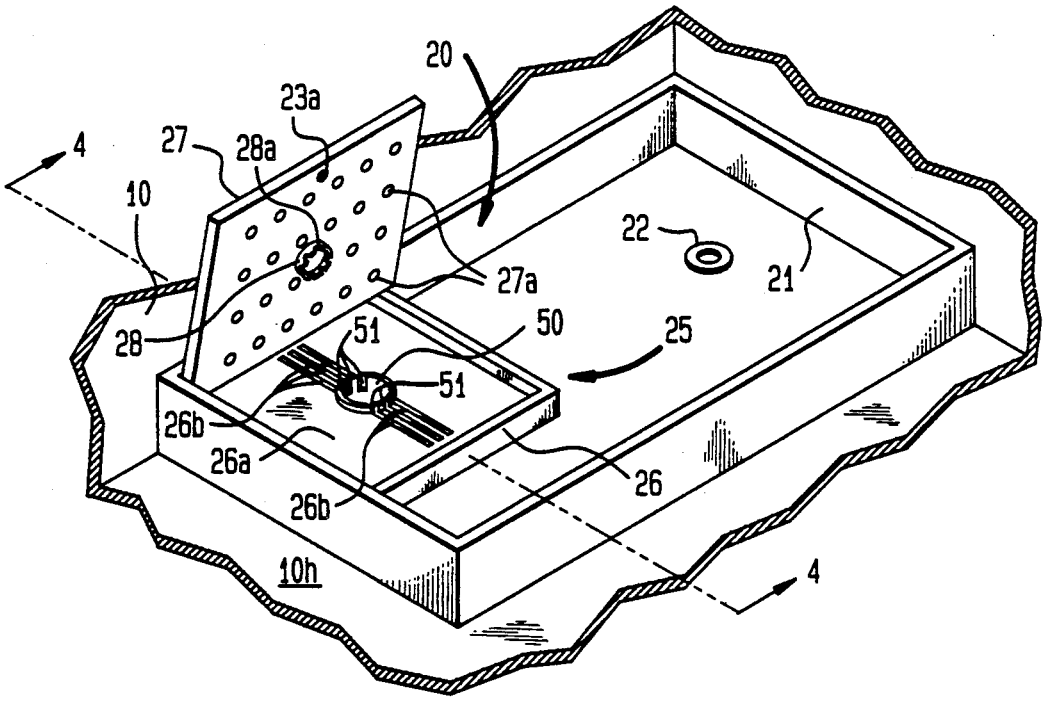
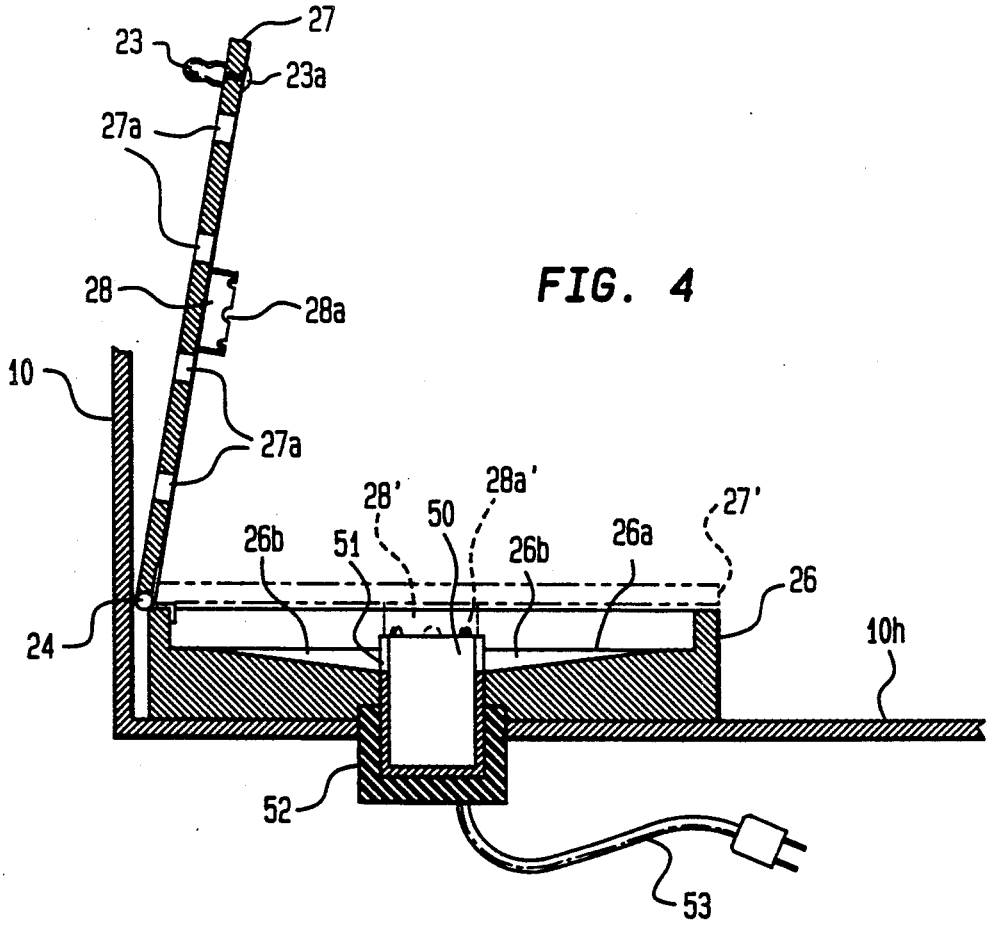
FIG. 4

STEAM CLOSET AND HANGER FOR THE REMOVAL OF WRINKLES FROM CLOTHING

BACKGROUND OF THE INVENTION

The present invention generally relates to the removal of wrinkles from articles of clothing and fabric material. More particularly, the present invention relates to means for removing wrinkles from articles of clothing and the like by exposing them to a steam bath in a closed closet.

Removing wrinkles from clothing by exposing them to a steam bath within a confined space is generally known in the prior art. The steam bath is most often accomplished by turning on the hot water faucet in a bathtub to generate a cloud of steam and then closing the bathroom door with the wrinkled clothing hung inside the bathroom. This procedure for wrinkle removal requires the use of a large amount of water that is otherwise wasted. Furthermore, it is often difficult to remove wrinkles from clothing by this method during travel because hotels and motels often put thermostats on the water supply to limit the water temperature and thereby prevent the heating of water to a sufficiently high enough temperature to generate steam. Thus there is a need within the art to provide means for generation of a steam bath within a confined space which eliminates the waste of water and heat accompanying the presently known means.

SUMMARY OF THE INVENTION

The present invention discloses a steam closet for the removal of wrinkles from clothing. The steam closet comprises a selectively sealable cabinet having a steam plant and suitable means to hang clothing in spaced relationship within the interior of said cabinet.

An object of the present invention is to provide means for removal of wrinkles from clothing by exposure of the clothing to a steam bath.

Another object of this invention is to provide means for generating steam within a closed space without the use of large quantities of water.

It is also an object of the present invention to provide a coin-operated steam bath for clothing suitable for use in a hotel or motel.

A further object of the present invention is to provide means for hanging articles of clothing in a steam closet that permits steam circulation about all sides of the hung articles of clothing.

These and other objects and advantages of the present invention will be apparent to those skilled in the art from the following description of a preferred embodiment, claims, and accompanying drawings.

BRIEF DESCRIPTION OF THE DRAWINGS

FIG. 3 is a top perspective view of the steam plant of the present invention shown with the steam generator cover in its open position.

FIG. 4 is a cross-sectional view taken along line A—A of FIG. 3.

DESCRIPTION OF A PREFERRED EMBODIMENT

Figure 1:
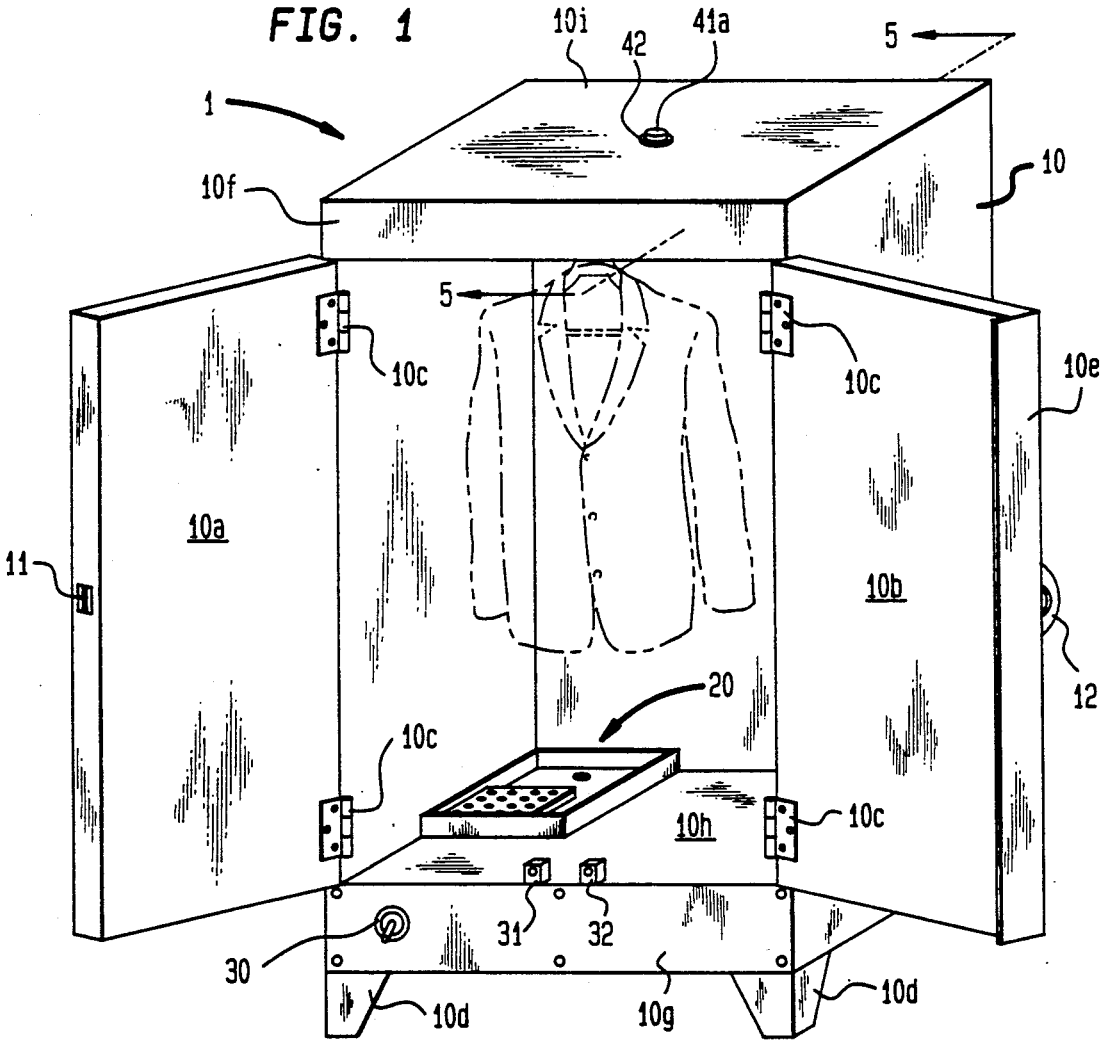
FIG. 1 is a front perspective view of the preferred embodiment of the present invention.

FIG. 1 illustrates in a front perspective view the steam closet 1 of the present invention. Steam closet 1 generally comprises an upright quadrilateral cabinet 10, a steam plant 20 disposed in the interior of said cabinet 10 and means to hang clothing 40 (FIG. 5) within said cabinet 10. The cabinet 10 includes a first door 10*a* and a second door 10*b* hingedly attached by hinge means 10*c* to the forepart of the respective side walls of said cabinet 10. Cabinet legs 10*d* are fixedly attached to the bottom of cabinet 10 to raise the bottom wall 10*h* of said cabinet 10 away from the floor or like surface. The second door 10*b* of said cabinet 10 includes a door handle 12 fixedly attached to the outside surface of said second door 10*b*, and a door flange member 10*e* which extends vertically along the free side edge of said second door 10*b*, said flange member 10*e* being formed from a magnetically attractive material. The first door 10*a* of said cabinet 10 includes a magnet 11 disposed in the free side edge of said first door 10*a*, thus said first and second doors 10*a*, 10*b* are sealingly engageable when closed by the magnetic attraction of said magnet 11 and said door flange member 10*e*.

The steam plant 20 of said steam closet 10 is disposed in the bottom wall 10*h* of said cabinet 10. Selective switching means 30 for said steam plant 20 are disposed in the lower front wall panel 10*g* of said cabinet 10 and safety switches 31, 32 operable by the opening of the respective doors 10*a*, 10*b* are disposed in the bottom wall 10*h* of said cabinet 10 in vertical alignment with said lower front wall panel 10*g* to provide means to automatically shut off the steam plant 20 when either door 10*a* or 10*b* is opened during operation of the steam plant 20.

Figure 2:
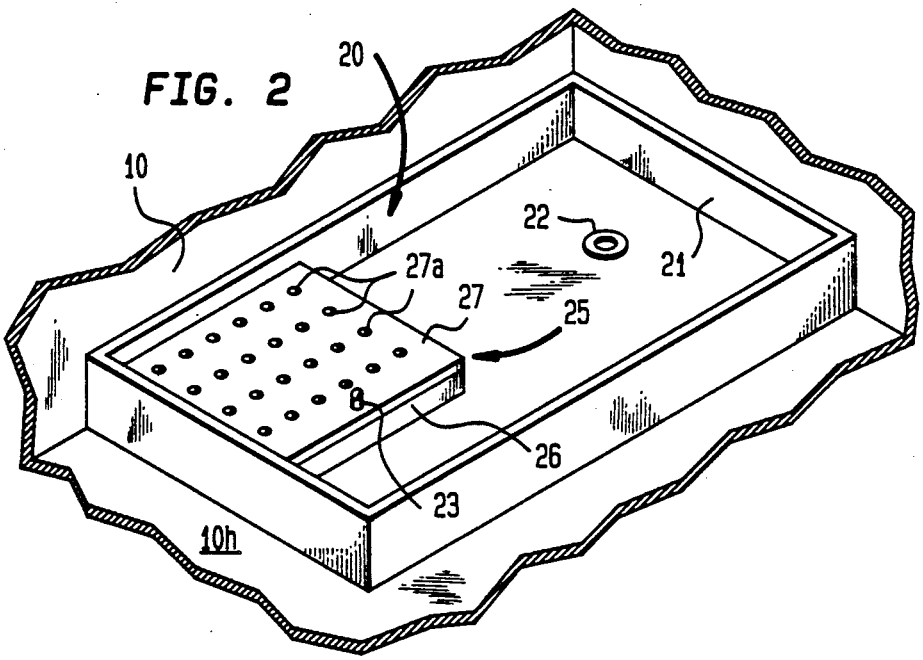
FIG. 2 is a top perspective view of the steam plant of the present invention shown with the steam generator cover in its closed position.

The details of said steam plant 20 can be best understood by reference to FIGS. 2–4. FIG. 2 illustrates in a top perspective view the steam plant 20 where it can be seen that steam plant 20 generally comprises a splash pan 21 disposed adjacent to the bottom wall 10*h* of said cabinet 10, and a steam generator 25 disposed within said splash pan 21. A splash pan drain 22 is formed in spaced relationship to said steam generator 25 within the floor of said splash pan 21 to drain away any excess water or condensation that collects in said splash pan 21. Steam generator 25 includes a generator frame bottom 26 and a generator frame cover 27, said generator frame cover 27 being shown in FIG. 2 in its closed position. Said generator frame cover 27 is hingedly attached to said frame bottom 26 by frame hinge means 24 (FIG. 4) and includes a cover knob 23 fixedly attached to said cover 27 by means of a knob screw 23*a* (FIGS. 3 and 4). A plurality of cover openings 27*a* are formed within said frame cover 27 to permit steam generated by said generator 25 to disperse therefrom to the interior of said cabinet 10.

The interior portions of said steam generator 20 can be best seen and understood by reference to FIGS. 3 and 4. FIG. 3 illustrates a top perspective view of the steam plant 20 showing the generator frame cover 27 in its open position. A heat baffle 28 is fixedly attached to the inside surface of said generator frame cover 27, said heat baffle 28 being formed as an inverted cup having a plurality of spaced cutaway portions 28*a* along its free edge. Heat baffle 28 is disposed substantially at the center of said generator frame cover 27 to facilitate steam generation as hereinafter described in greater detail. A steam pot 50 is disposed in the floor 26*a* of said generator frame bottom 26, said steam pot 50 being provided to receive a quantity of water for generation of the requisite steam for operation of the present invention. The upper edge of said steam pot 50 extends above the floor 26*a* of said frame bottom 26 and includes a plurality of vertical slots 51 formed in laterally displaced portions of the extending edge of said steam pot 50. The vertical slots 51 communicate with respective grooves 26*b* formed in the floor 26*a* of said frame bottom 26*a*. The grooves 26*b* are provided to return any liquid water that spills from said steam pot 50 back into said steam pot 50. To this end, as can be seen in the side cross-sectional view of the steam plant 20 shown in FIG. 4, the grooves 26*b* are formed with a bottom wall that angles downwardly toward the slots 51 of said steam pot 50. Steam pot 50 is disposed in conductive heat relationship with an electrical heating element 52 which is fixedly attached to the bottom wall 10*h* of said cabinet 10, said heating element 52 including an electrical cord and outlet adapter 53.

Figure 5:
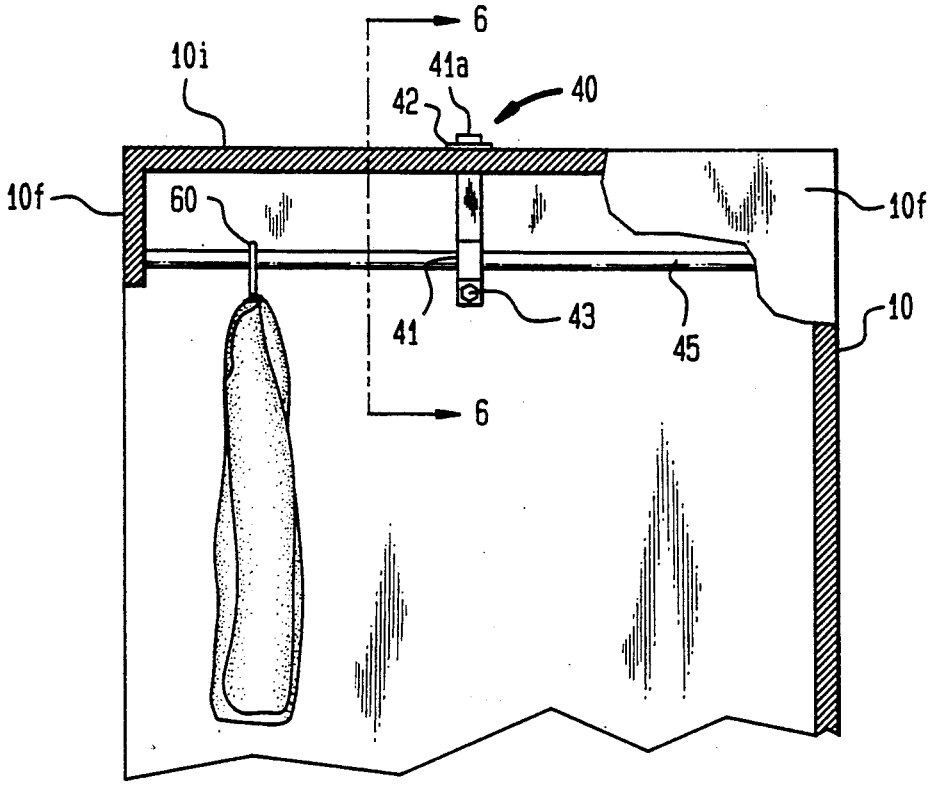
FIG. 5 is a cross-sectional view taken along line B—B of FIG. 1.
Figure 6:
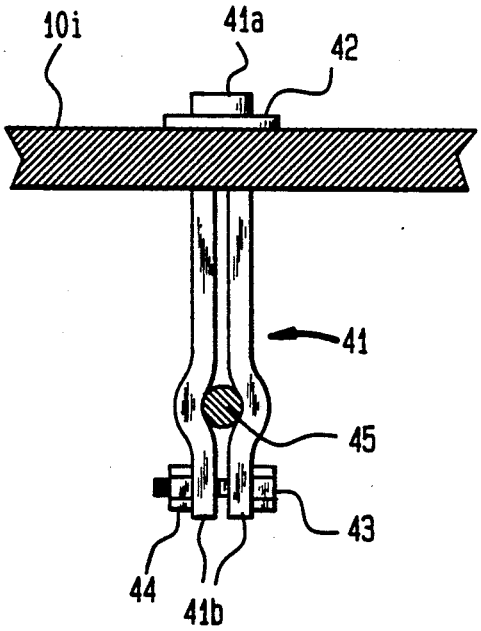
FIG. 6 is a cross-sectional view taken along line C—C of FIG. 5.

Clothes hanger means 40 of the present invention is illustrated in FIGS. 5 and 6 where it can be seen that said clothes hanging means 40 is disposed behind the upper front wall panel 10*f* of said cabinet 10 and comprises a hanger rod 45 provided for receipt of one or a plurality of clothing hangers 60, and a hanger rod support 41 which fixedly attaches said rod 45 to said cabinet 10. Hanger rod support 41 is formed having a top end 41*a* which protrudes through the top wall 10*i* of said cabinet 10 and extends downwardly to a pair of integrally formed support prongs 41*b* (FIG. 6). Rod support fastener means 42 engage said top end 41*a* to fixedly attach said rod support 41 to the cabinet 10. The support prongs 41*b* of said rod support 41 are fastened about said hanger rod 45 by means of a threaded bolt 43 which extends through the lower end of said support prongs 41*b*, said bolt 43 being fixedly attached to said support prongs 41 by means of a complementarily threaded bolt nut 44.

With the steam closet 1 of the present invention constructed as heretofore described, a cloud of steam can be generated within the closed confines of the cabinet 10 in the following manner. Firstly, a quantity of water is placed in the steam pot 50 of the steam generator 20. The generator frame cover 27 is then lowered adjacent to the generator frame bottom 26. The switching means 30 is then selectively activated to operate the heating element 52 of the steam plant 20 thereby heating the water retained in the steam pot. As can be seen in FIG. 4, when the frame cover 27 is placed in its lowered position, as shown by the phantom lines, the heat baffle 28' is disposed in vertical alignment with said steam pot 50 to retain a pressurized environment which facilitates heating of the water disposed in said pot 50. The cutaway portions 28*a'* of said heat baffle 28' allow the generated steam to escape the steam pot 50 and thereby rise through the openings 27*a* formed in said generator frame cover 27.

Figure 7:
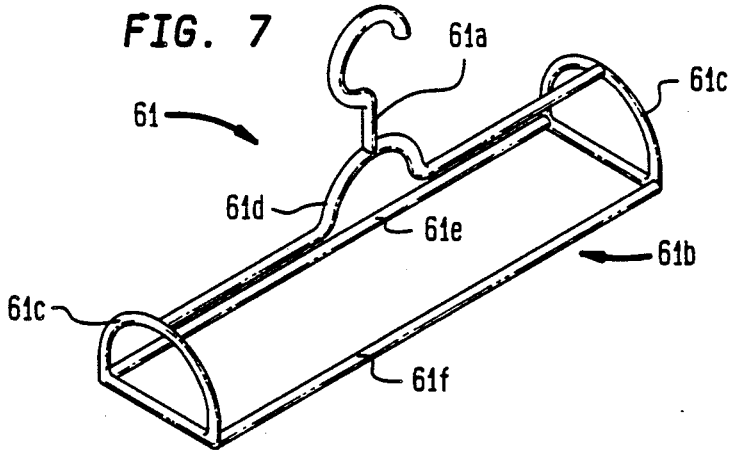
FIG. 7 is a perspective view of a first preferred embodiment of a steam closet clothing hanger suitable for use in the steam closet of the present invention.
Figure 8:
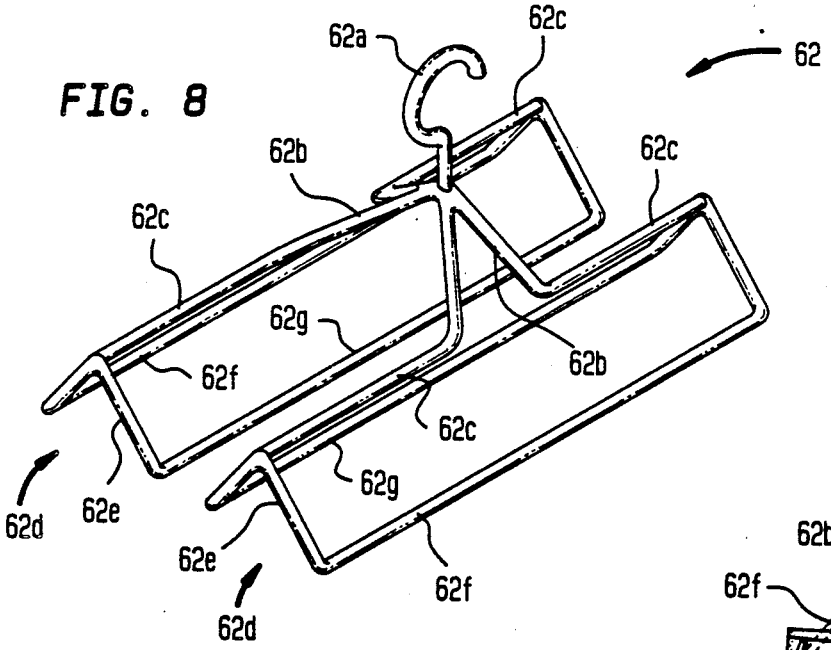
FIG. 8 is a perspective view of a second embodiment of a steam closet clothing hanger suitable for use in the steam closet of the present invention.
Figure 9:
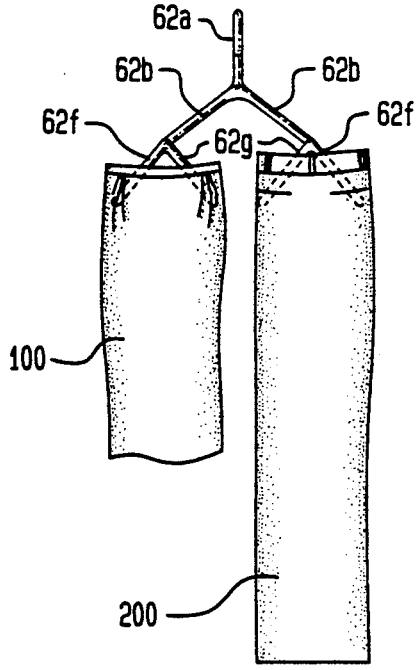
FIG. 9 is an end view of the second preferred embodiment of the steam closet clothing hanger shown with a skirt and a pair of pants hung thereon.

To facilitate the removal of wrinkles from clothing hung in the steam closet 1, it is preferred that clothing hangers 60 utilized to hang an article of clothing be formed as a bent frame deformed in a manner that will permit the generated steam to circulate about all sides of the article of clothing. FIGS. 7–9 illustrate first and second preferred embodiments of clothing hangers 61, 62 to meet this end. In FIG. 7 a first preferred embodiment of a clothing hanger 61 is shown suitable for hanging a coat or dress. The first embodiment of the clothing hanger 61 is formed having a hanger head 61*a* integrally formed with a trilateral hanger body 61*b* defined by a pair of triangular end frames 61*c* interconnected by a top frame beam 61*d* and respective side frame beams 61*e*, 61*f*. Said top frame beam 61*d* and the respective side frame beams 61*e*, 61*f* are integrally connected to the respective angles of the end frames 61*c* and extend thereinbetween. Hanger head 61 is integrally formed with the top frame beam 61*d* of said hanger body 61*b* and extends vertically therefrom.

FIG. 8 illustrates in a perspective view a second preferred embodiment of a clothing hanger 62. The second embodiment of the clothing hanger 62 is suitable for hanging pants or a skirt. Clothing hanger 62 is formed having a hanger head 62*a*, a pair of hanger necks 62*b* angularly disposed downwardly from said hanger head 62*a* and extending therefrom to respective hanger shoulders 62*c*, and a pair of hanging support frames 62*d* supported at the ends of said hanger shoulders 62 and comprising angled end members 62*e* interconnected by respective support frame beams 62*f*, 62*g* fixedly attached to the ends of said angled end members 62*e*. A pair of pants or a skirt can be attached to the respective paired support frame beams 62*f*, 62*g* in a manner to permit the pants or skirt to be disposed thereon having the sides of said pants or skirt spread apart.

FIG. 9 illustrates an end view of the second preferred embodiment of the clothing hanger 62 showing a skirt 100 and a pair of pants 200 disposed on the respective hanging support frames 62*d*.

Figure 10:
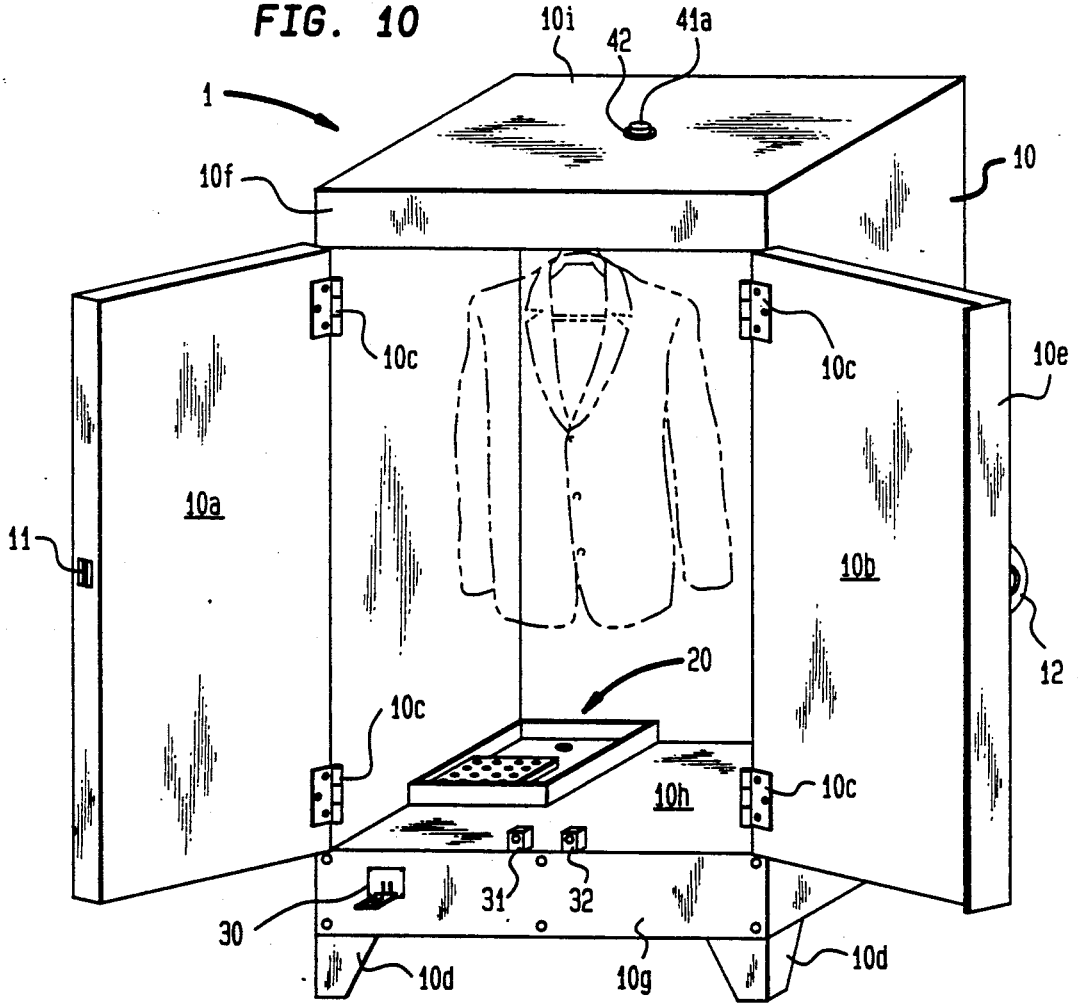
FIG. 10 is a front perspective view of a coin-operated steam closet constructed in accordance with the teachings of the present disclosure.

FIG. 10 illustrates a coin-operated steam closet 1' constructed in accordance with the teachings of the present disclosure. Coin-operated steam closet 1' is constructed substantially the same as the preferred embodiment of the steam closet 1 illustrated in FIG. 1 and described heretofore. In lieu of the selectively operable switching means 30, coin-operated switching means 30' of the type generally known for coin-operated appliances is provided.

While the present invention has been described in reference to a preferred embodiment, this description is not intended to be a limitation of the present disclosure as hereinafter claimed. Various changes, modifications, additions and deletions may be made to the present invention as described without departing from the spirit and scope of the present invention, for example, a heating element timer or a coin-operated switching means may be included in the present invention, and such changes are within the present invention as claimed. Furthermore, various embodiments of the clothing hanger 62 may be utilized to achieve the same purposes of the present invention.

Therefore, in view of the foregoing I claim:

1. A device for removing wrinkles from articles of clothing by exposure of said articles of clothing to a steam bath in combination with at least one clothing hanger formed to receive an article of clothing said device comprising a selectively sealable closet wherein said closet comprises a quadrilateral sided cabinet having sealably engageable first and second doors respectively and hingedly attached to opposing sides of said cabinet at a forepart thereof, said first door having a magnet disposed in an unattached side of said first door, said second door having a flap member formed from magnetically attractive material disposed along an unattached side of said second door and a handle fixedly attached to an outside surface of said second door, said first and second doors thereby being sealingly engageable by magnetic attraction between said magnet and said flap member when closed;

means to generate steam within said closet comprising a steam plant disposed within said steam closet, said steam plant including a water receptacle having liquid water retained therein, means to heat said water receptacle to a temperature sufficiently high to transform the liquid water retained within said receptacle to water vapor, and means for escape of said water vapor from said steam plant and for retention of said water vapor within said closet; and means to hang articles of clothing within said closet comprising a hanger rod fixedly attached to a top portion of said closet, said hanger rod being disposed to receive said clothing hanger, said clothing hanger being formed to receive an article of clothing for the circulation of steam about all sides of said article of clothing disposed on said hanger, said clothing hanger comprising a bent frame including a hanger head receivable upon said hanger rod and a trilateral hanger body integrally formed with said hanger head, said trilateral hanger body being defined by a pair of triangular end frames interconnected by a top frame beam and first and second side frame beams, ends of said top frame beam and said first and second side frame beams being attached at angles of the respective triangular end frames and said hanger head being attached to a central portion of said top frame beam.

2. A device for removing wrinkles from articles of clothing by exposure of said articles of clothing to a steam bath, said device comprising a selectively sealable closet, means to generate steam within said closet, a clothing hanger rod fixedly attached to a top portion of said closet, and at least one clothing hanger disposable in spaced relationship on said clothing hanger rod, said clothing hanger comprising a bent frame deformed to include a hanger head, a pair of hanger necks angularly disposed from said hanger head extending to hanger shoulders, and a pair of hanging support frames supported at ends of each said hanger shoulder, each said hanging support frame comprising angled end members interconnected at ends of each said angled end member by respective support frame beams.

3. A device for removing wrinkles from articles of clothing by exposure of said articles of clothing to a steam bath, said device comprising an upright quadrilateral sided cabinet having a top wall, a bottom wall, opposing side walls, a rear wall, a plurality of legs attached to said cabinet in a manner as to support said bottom wall above a floor surface, and a first door and a second door respectively and hingedly attached to a forepart of the respective side walls of said cabinet, said first door and said second door being sealingly engageable when closed;

a steam generation plant disposed upon the bottom wall of said cabinet, said steam generation plant including a generator frame having a hingedly attached frame cover, said frame cover having a heat baffle attached to an inside wall of said frame cover and a plurality of openings formed within said frame cover disposed about said heat baffle, said heat baffle being formed as an inverted cup having a plurality of cutaway portions disposed along a free edge, said generator frame being disposed within a splash pan, said splash pan having a water drain formed in a floor of said splash pan in spaced relationship to said generator frame, said generator frame including a water receptacle disposed in a floor of said frame, said water receptacle having an upper edge projecting above the floor of said generator frame and a plurality of slots in laterally spaced relationship formed in a projecting upper edge of said water receptacle, said generator frame having a plurality of grooves formed in the floor of said frame in alignment with said slots of the water receptacle, the bottom wall of said grooves angling downwardly toward said water receptacle, the top edge of said water receptacle and a bottom edge of said heat baffle being disposed in vertical alignment when said frame cover is disposed onto said frame, said steam generation plant further including an electrical heating element disposed in heat conductive contact with a bottom portion of said water receptacle;

selective switching means for said electrical heating element, a clothing rod fixedly attached to a top portion of said cabinet, and means to dispose articles of clothing upon said clothing rod in a manner for steam from said steam generation plant to circulate about sides of said articles of clothing.

4. A device as described in claim 3 wherein said selective switching means is coin-operated.

5. A device as described in claim 3 further including at least one safety switch operable by the opening of either the first or second door of said cabinet to thereby automatically shut off said steam generation plant when said first or second door is opened during operation of said plant.

* * * * *